US006390680B1

(12) United States Patent
Last

(10) Patent No.: US 6,390,680 B1
(45) Date of Patent: May 21, 2002

(54) EXTRUDED TRACK CONSTRUCT COMPONENT SYSTEM WITH THREADED RADIAL BEARING END PULLEY FOR SWIMMING POOL COVER SYSTEMS

(76) Inventor: Harry J. Last, 122 Dunecrest Ave., Monterey, CA (US) 93940

( * ) Notice: Subject to any disclaimer, the term of this patent is extended or adjusted under 35 U.S.C. 154(b) by 0 days.

(21) Appl. No.: 09/657,676

(22) Filed: Sep. 8, 2000

(51) Int. Cl.[7] ..... F16C 13/00
(52) U.S. Cl. ..... 384/55; 384/547; 384/542
(58) Field of Search ..... 384/542, 540, 384/543, 546, 547, 445, 55; 474/165, 199, 903

(56) References Cited

U.S. PATENT DOCUMENTS

| | | | | | |
|---|---|---|---|---|---|
| 2,190,336 | A | * | 2/1940 | Olson | 384/546 |
| 3,469,892 | A | * | 9/1969 | Langstroth | 384/547 X |
| 3,982,286 | A | * | 9/1976 | Foster | 4/502 |
| 4,466,144 | A | * | 8/1984 | Lamb | 4/503 |
| 4,486,056 | A | * | 12/1984 | Brandenstein et al. | 384/546 X |
| 4,577,352 | A | * | 3/1986 | Gautheron | 4/499 |
| 4,815,863 | A | * | 3/1989 | Forster | 384/49 |
| 4,939,798 | A | * | 7/1990 | Last | 4/502 |
| 4,967,424 | A | * | 11/1990 | Stegmeier | 4/496 |
| 5,349,707 | A | * | 9/1994 | Last | 4/502 |
| 5,799,342 | A | * | 9/1998 | Last | 4/502 |
| 5,845,343 | A | * | 12/1998 | Last | 4/502 |
| 5,950,253 | A | * | 9/1999 | Last | 4/502 |

* cited by examiner

*Primary Examiner*—Thomas R. Hannon

(74) *Attorney, Agent, or Firm*—David E. Newhouse, Esq.

(57) ABSTRACT

An invented track construct component system with a threaded radial bearing end pulley is described for pool cover systems that includes an extruded longitudinal cover track having a top longitudinal anchoring slot, a C-channel longitudinal slot along one side edge for capturing and holding a side edge of a pool cover and associated sliders carrying a leading (front) edge structures, a cable return channel with a longitudinal slot opening along the other side edge for receiving and protecting cabling connecting between sliders/front cover comers and associated cable reels. Each cover track is secured within separate extruded side wall channel structures having a top channel side wall with a depending longitudinal shaped for snuggly fitting into the longitudinal anchoring slot of the cover track. The extruded side wall channel structures are incorporated into the side wall of the pool. A longitudinal spacer plate is inserted between the bottom channel side wall of the wall channel structure and the planar base face of the anchor track for mechanically holding the cover track within the wall channel with its anchoring slot snuggly receiving the depending longitudinal land of the wall channel. A similar extruded wall channel structure is incorporated into the end wall of the pool for accommodating an extending coupling plate-radial bearing end pulley assembly fastened at the distal end of the cover track.

The radial bearing end pulley includes a novel inner annular race with an interior helical thread for screwing onto a perpendicularly extending, complementarily threaded, post integral with the coupling plate, and a rotating outer annular race with a concave exterior, circumferential groove for receiving, carrying and returning cabling connecting between a slider/front cover corner and a cable reel.

7 Claims, 12 Drawing Sheets

EXTRUDED TRACK CONSTRUCT COMPONENT SYSTEM WITH THREADED RADIAL BEARING END PULLEY FOR SWIMMING POOL COVER SYSTEMS

BACKGROUND OF THE INVENTION

1. Field of the Invention

This invention relates to swimming pool cover systems, and in particular, to extruded swimming pool track constructs which anchor a pool cover along a pool side edges and related pulleys carrying cables for cover extension and retraction.

2. Description of the Prior Art

Swimming pool cover systems typically include covers formed from flexible vinyl fabrics or interconnected rollable (hinged) rigid buoyant slats (See U.S. Pat. No. 4,577,352 Gautheron). Such pool covers float on the water surface of the pool and are anchored/supported along the sides and ends of the pool. When covering and uncovering, pool water provides a low friction surface supporting the cover which significantly reduces the effort required to move the cover across the pool.

Typically mechanical systems are utilized to draw the cover back and forth across the pool in which a cable, typically a Dacron line, is incorporated into to form a flexible beaded edge sewn or otherwise secured to the side edges of the pool cover. The beaded edge in turn is captured and slides within a C-channel of an extruded aluminum cover track. The track is secured either to the pool deck, or the underside of an overhanging coping along the sides of the pool. In new pools, the side walls of the pool frequently are constructed with integral channels for receiving the cover track and securing vinyl pool liners. (See U.S. Pat. No. 4,967,424 Stegmeier)

The cables extending from the beaded edges at the front of the cover, are trained around pulleys at the distal ends of the tracks (See U.S. Pat. No. 4,466,144 Lamb) and return in a parallel C-channel to a drive mechanism where they wind onto and unwind from cable take-up reels. The cable take-up reels are coupled to a drive mechanism for extending the cover. To uncover the pool, the drive mechanism rotatably drives a cover drum located and secured at one end of the pool for winding the pool cover around its periphery unwinding the cables from the take-up reels. (See U.S. Pat. No. 5,799,342, Last)

The front edges of flexible vinyl covers are typically secured to and supported by a rigid leading edge spanning the width of the pool for holding the front edge of the cover above the water as it is drawn back and forth across the pool. Similarly, rollable buoyant slat covers frequently include a front or floating leading edge. Leading edges are typically secured to and mechanically supported by sliders sliding in the C-channel of the cover track coupled to the cable extending from the flexible beaded edge of the cover. (See U.S. Pat. Nos. 4,939,798 & 5,950,253 Last.) Positive stops are sometimes secured at the ends of the pool cover tracks for positively arresting translation of the sliders sliding within the C-channels carrying the rigid leading edges. (See U.S. Pat. No. 5,349,707 Last.)

Wearing components of mechanical swimming pool cover systems must be replaceable. In particular, a swimming pool is a harsh environment. The water and treating chemicals are corrosive, galvanically and otherwise. Intense sunlight exposure typical of outdoor pool exacerbates deterioration of exposed components, converting pliable vinyl plastics into flaking sharp shards. Then the sliding components of the mechanical pool cover systems tend collect and concentrate floating debris and crud at wearing interfaces. Such collected and concentrated debris and crud in turn entraps dirt, dust, and sand to transform into a flowable abrasive grit which insinuates itself into every moving component of the cover system, particularly the end pulleys and related assemblies.

Replacing end pulleys in mechanical swimming pool cover systems is a particularly irksome task. Even removable end pulleys of the type described in U.S. Pat. No. 4,446,144 Lamb are difficult to replace. In particular, as noted in Lamb while a tang extending from the assembly into a channel between the respective C-channels of the extruded track promotes alignment of pulley, the extending tang does not prevent the assembly from oscillating loose when loaded. (See Lamb (supra) Col. 5, line 25—Col. 6, line 42.) The upshot is, that in practice, even the Lamb end pulley and related housing assembly should be securely bolted to or fastened at a stationary position relative to the end of the track, otherwise the oscillating loads experienced by the pulley bend or deform the pulley housing material and/or deform the end of the track.

Then as noted in Lamb (Col. 4, lines 55 to Col. 5, line 2) because of the loads experienced by such end pulley assemblies, it is generally preferable to provided bores through the assembly through which a cable is strung rather than grooves. (Lamb does point out that if stronger materials were utilized for constructing the pulley housing, grooves would be preferred.) Lamb fails to mention attendant galvanic corrosion problems between such stronger materials and aluminum swimming pool track. As a practical matter, whenever a pulley fails, unless its housing assembly is mechanically isolated from the track end, the housing is damaged and track end deformed, simply because the typical pool owners, not knowing why a cover is not properly extending/retracting, all too frequently, will overstress the system into catastrophic failure trying to make it work.

Accordingly, when an end pulley must be replaced, the either entire cable must be unstrung through the damage pulley assembly and re-threaded through the replacement pulley assembly or the cable must be cut and then spliced. The latter alternative inevitably leads to a broken or snagged cable and a pool owner demanding a replacement.

Finally, contemplate the problems confronting a repair person attempting to replace an end pulley assembly mounted on the underside of an overhanging coping along the sides of the pool, or at the end, within an extruded aluminum channel integrated into the structural side wall of the pool. (See FIG. 1, U.S. Pat. No. 5,349,707, Last.) If water is not drained from the pool, a snorkel or scuba tank would be required.

SUMMARY OF THE INVENTION

An invented track construct component system with a threaded radial bearing end pulley is described for pool cover systems that includes:

a) an extruded longitudinal cover track having
   - (i) a top face with a longitudinal anchoring slot and a planar base face
   - (ii) a C-channel with a longitudinal slot opening along an outside side edge of the cover track for capturing and holding a side edge of a pool cover and associated sliders carrying leading (front) edge structures,
   - (iii) a cable return channel with a longitudinal slot opening along an inside side edge of the cover track for receiving and protecting cabling connecting between the sliders/front cover corners and associated cable reels; and b) an extruded side wall channel structure having a top channel side wall with a depending longitudinal land and a flat, bottom channel side wall adapted for and incorporated into the structure of the side wall of the pool for receiving a cover track wherein the depending longitudinal land is shaped for snuggly fitting into the longitudinal anchoring slot of the cover track; and c) a longitudinal spacer plate adapted for and inserted between the flat, bottom flat channel side wall of the wall channel structure and the planar base face of the cover track for mechanically holding the cover track within the wall channel with its anchoring slot snuggly receiving the depending longitudinal land of the wall channel structure, and d) a coupling plate—radial bearing end pulley assembly fastened at the distal end of each cover track.

The distal end wall of the pool includes a similar extruded end wall channel structure for accommodating the coupling plate—radial bearing end pulley assembly fastened at the distal end of each cover track.

The coupling plate—radial bearing end pulley assembly includes a novel inner annular bearing race with interior helical threads for screwing onto a perpendicularly extending, complementarily threaded, post integral with the coupling plate. The outer annular bearing race has a concave exterior, circumferential groove for receiving, carrying and returning cabling connecting between a slider/front cover corner and a cable reel.

A primary advantage of the invented extruded track construct component system with a threaded radial bearing end pulley is that a cover track can be easily removed from a wall channel structure by simply extracting the longitudinal spacer plate allowing mechanical disengagement of the depending longitudinal land in the anchoring slot of the cover track. Once the longitudinal spacer plate is extracted, distal end of the cover track can be slid diagonally sideways out of the wall channel preferably pivoting from the opposite end of the cover track proximate a cover drum and associated cable reels of the cover drive system. In this manner the radial bearing end pulley—coupling plate assembly fastened at the distal end of the cover track is exposed for easy repair or replacement.

Other advantages of the invented system relate to the 'thinness' and structural integrity of the radially bearing end pulley-coupling plate assembly achieved by a novel combination of a helically threaded, annular inner bearing race screwing onto a complimentary, helically threaded post for fastening the radial bearing to a coupling plate. In particular, the thickness of the end pulley-coupling plate assembly can be matched to that of the extruded pool cover track to which it is attached. Protruding shaft ends and associated retainer clips, nuts collars and the like, typical for such replaceable radial bearing end pulley assemblies are eliminated.

The invented novel combination of a helically threaded annular inner bearing race screwing onto a complimentarily threaded post as a mechanism for fastening or securing a radial bearing has similar advantages in many other types of mechanical systems utilizing radial bearings, in particular, those systems where the annular inner race of the radial bearing journals around and is stationary with respect to its mounting shaft or spindle and its annular outer race rotates relative to the inner race engaging and/or carrying a complimentary belt, cable or gear. The threaded engagement of the inner bearing race onto a post of a coupling plate eliminates the necessity for thrust bearings, annular retainer clips, bolts, collars, set screws and like typically utilized for securing such bearing assemblies onto shafts and spindles.

In mechanical systems where rotation of the radial bearing is only in one direction, the inner race and post of the invented bearing assembly can be threaded in a direction such that system rotation tightens threaded engagement of the inner race on the post.

Also in top track pool cover systems where the cover track is secured to the top surface of a deck surrounding the pool, the threaded the inner annular race of the radial bearing end pulley uniquely allows a pulley cap to be secured covering the pulley and coupling plate assembly by a complimentarily threaded flat or round head screw that screws into the inner race of the bearing.

Other features of the invented extruded track construct component system relates to postconstruction utilization of plastic plug rails conventionally used to maintain the integrity of the channels of extruded wall channel structures during pool during construction, to close the channel opening of a wall channel incorporated into the distal end wall of the pool to prevent debris capable of fouling the radial bearing end pulleys assemblies from collecting in the end wall channel.

Still other features, aspects, advantages and objects presented and accomplished by invented track construct component system and associated threaded radial bearing assembly systems will become apparent and/or be more fully understood with reference to the following description and detailed drawings of preferred and exemplary embodiments.

DESCRIPTION OF PREFERRED AND EXEMPLARY EMBODIMENTS

FIGS. 3(*a*),3*b*, 3*c* & 3*d* are end cross section elevation views of the longitudinal components of the invented track construct component system.

Figure 4:
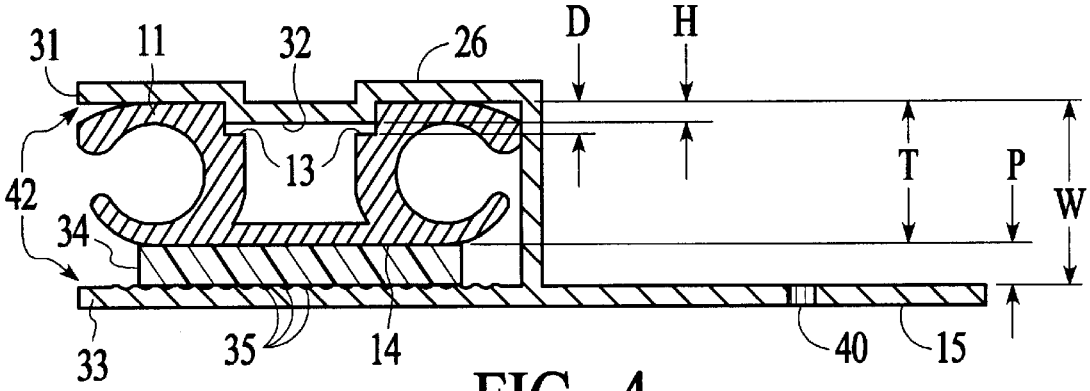

FIG. 4 is an end cross section view of the longitudinal components of the invented track construct component system assembled.

Figure 5A:
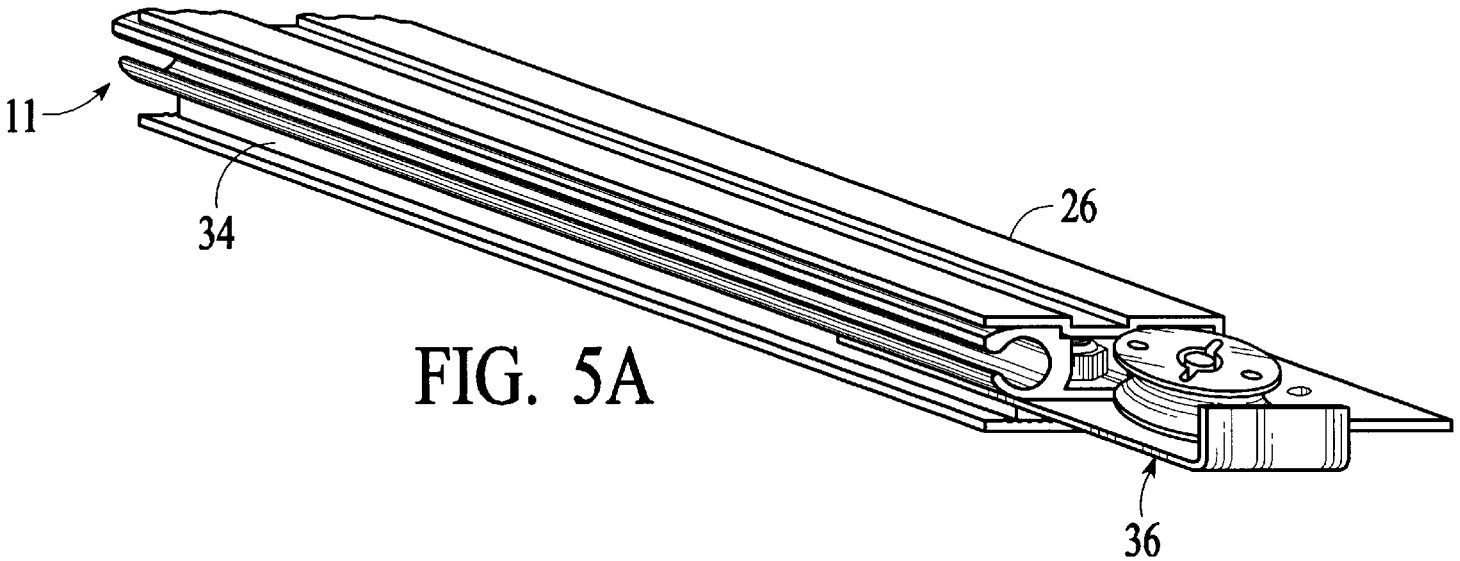
Figure 5B:
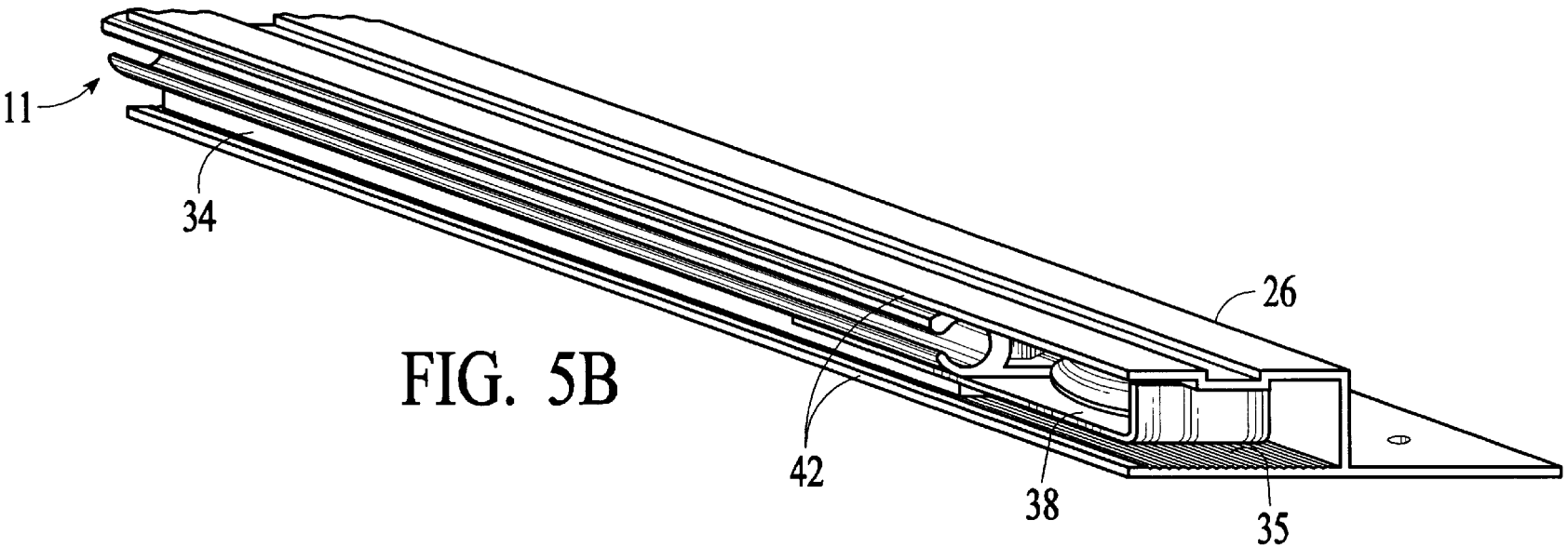

FIGS. 5*a* & 5*b* are perspective views of the assembled components of the invented track construct component system where the radial bearing end pulley assembly extends beyond FIG. 5(*a*) or within FIG. 5(*b*) the enclosing extruded wall channel.

Figure 6:
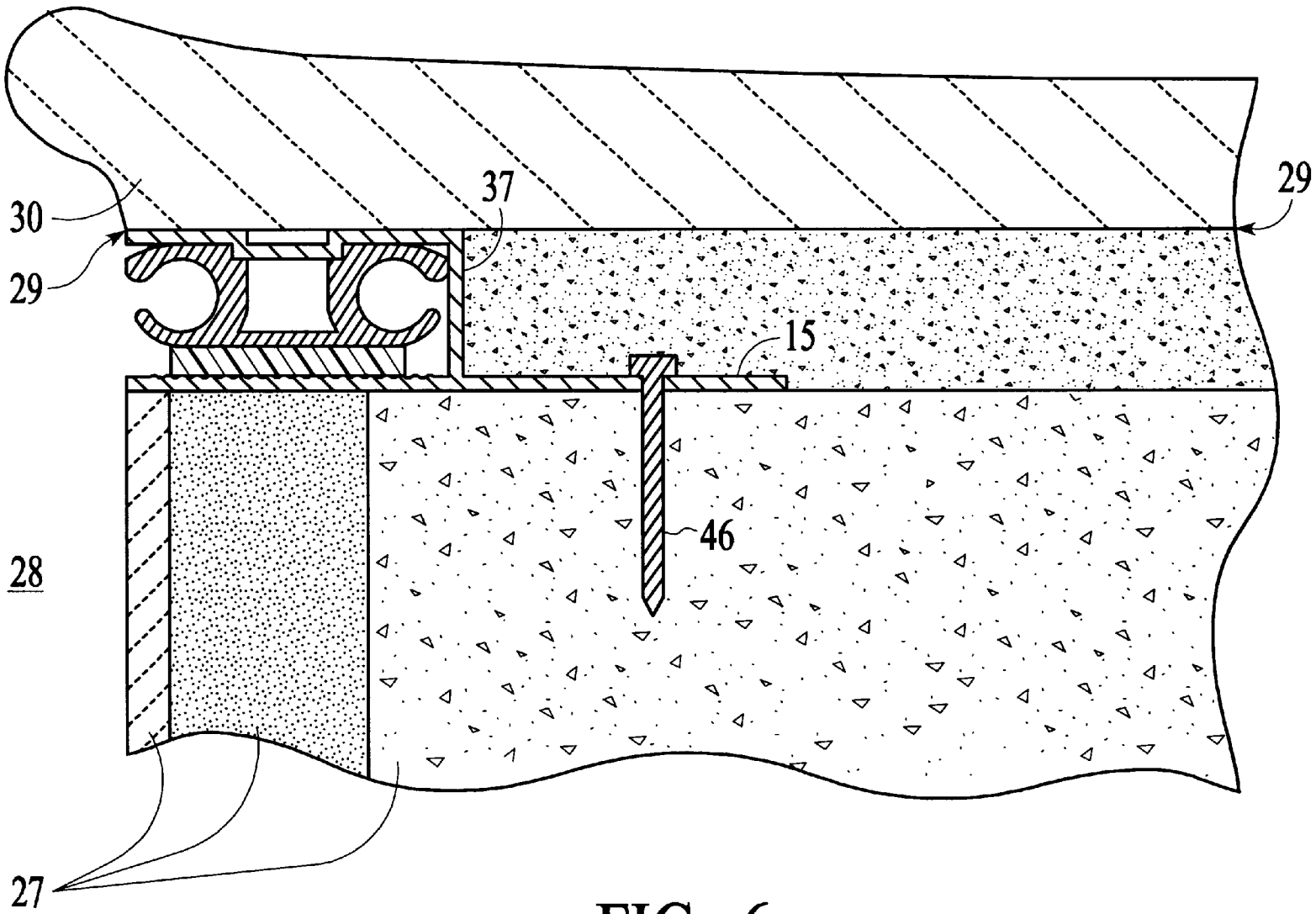

FIG. 6 is a cross section elevation view of the side wall of a pool showing the longitudinal components of the invented track construct component system installed.

Figure 7A:
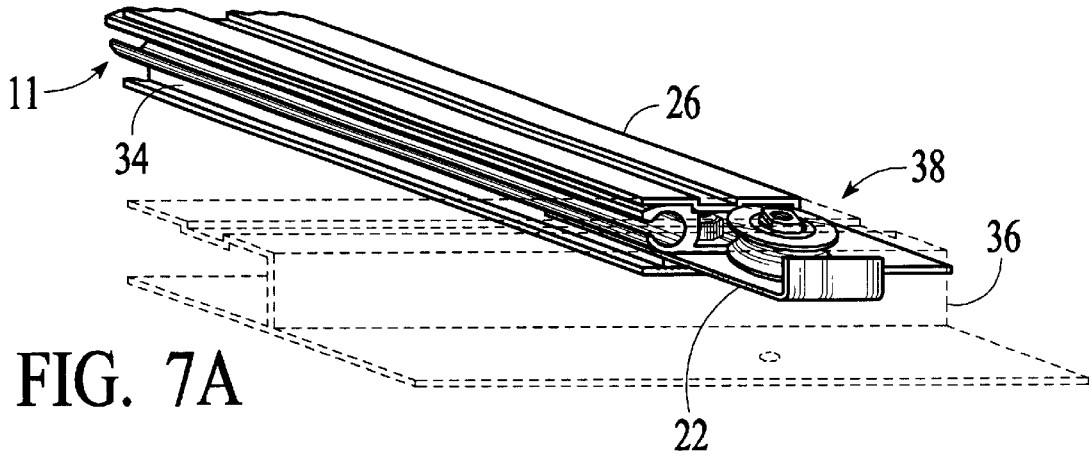
Figure 7B:
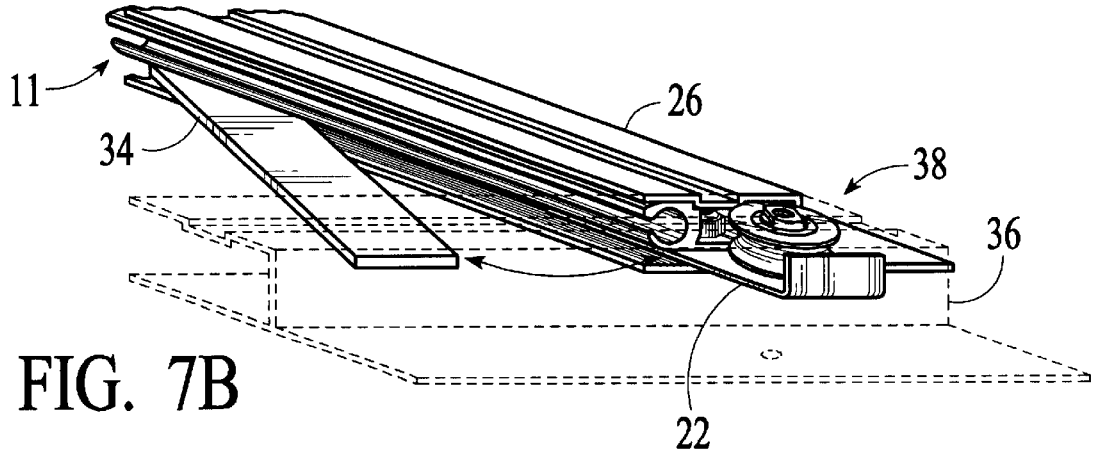
Figure 7C:
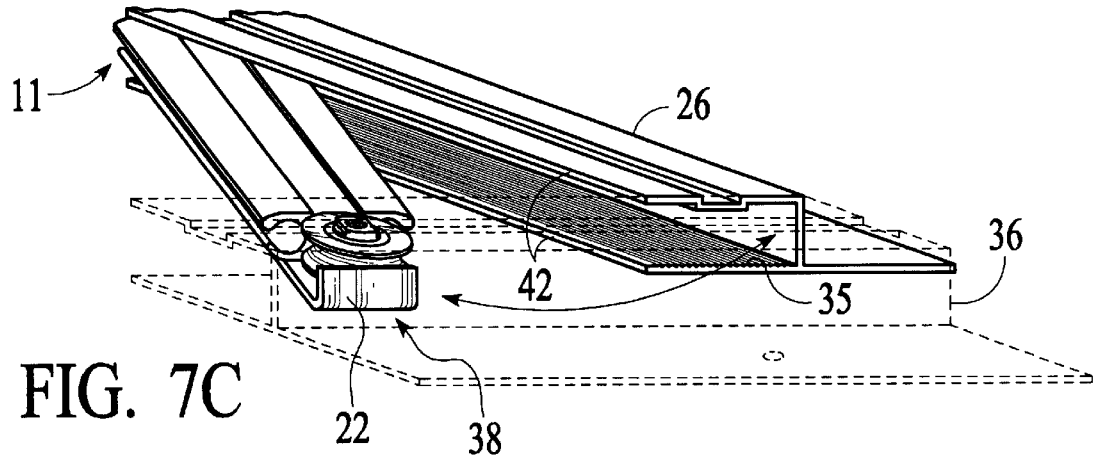

FIGS. 7*a*, 7*b* & 7*c* are perspective renderings of the invented track construct component system illustrating procedures for insertion and extraction of the cover track from within the extruded wall channel.

Figure 8A:
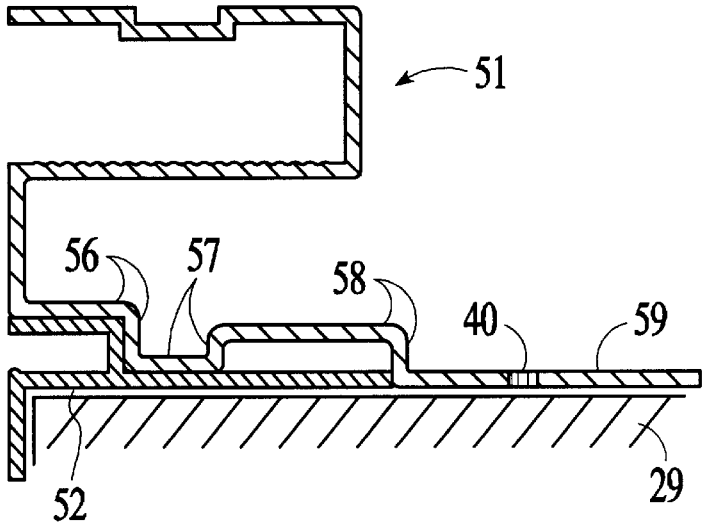
Figure 8B:
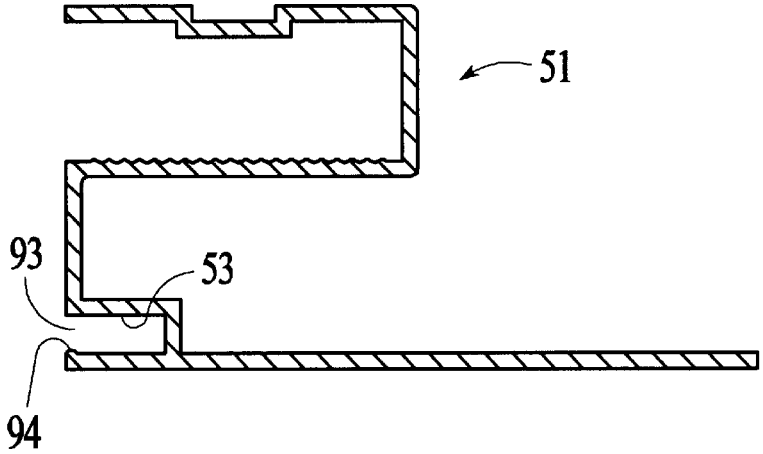

FIGS. 8*a* & 8*b* are end cross section elevation views of different wall channels tracks of the invented track construct component system adapted for lined pools.

Figure 9:
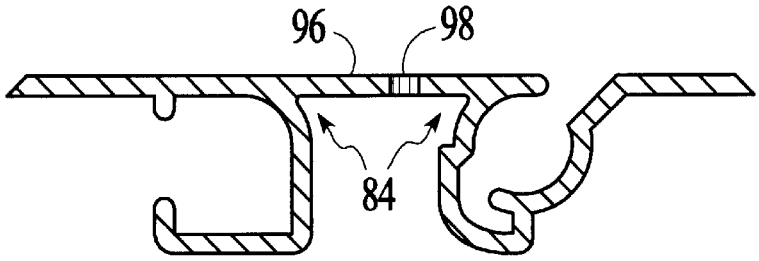
FIG. 9 (PRIOR ART)

FIG. 9 is a cross section view of a flush top cover track of the type described by the Applicant in his U.S. Pat. Nos. 5,845,893 & 5,950,253.

Figure 10:
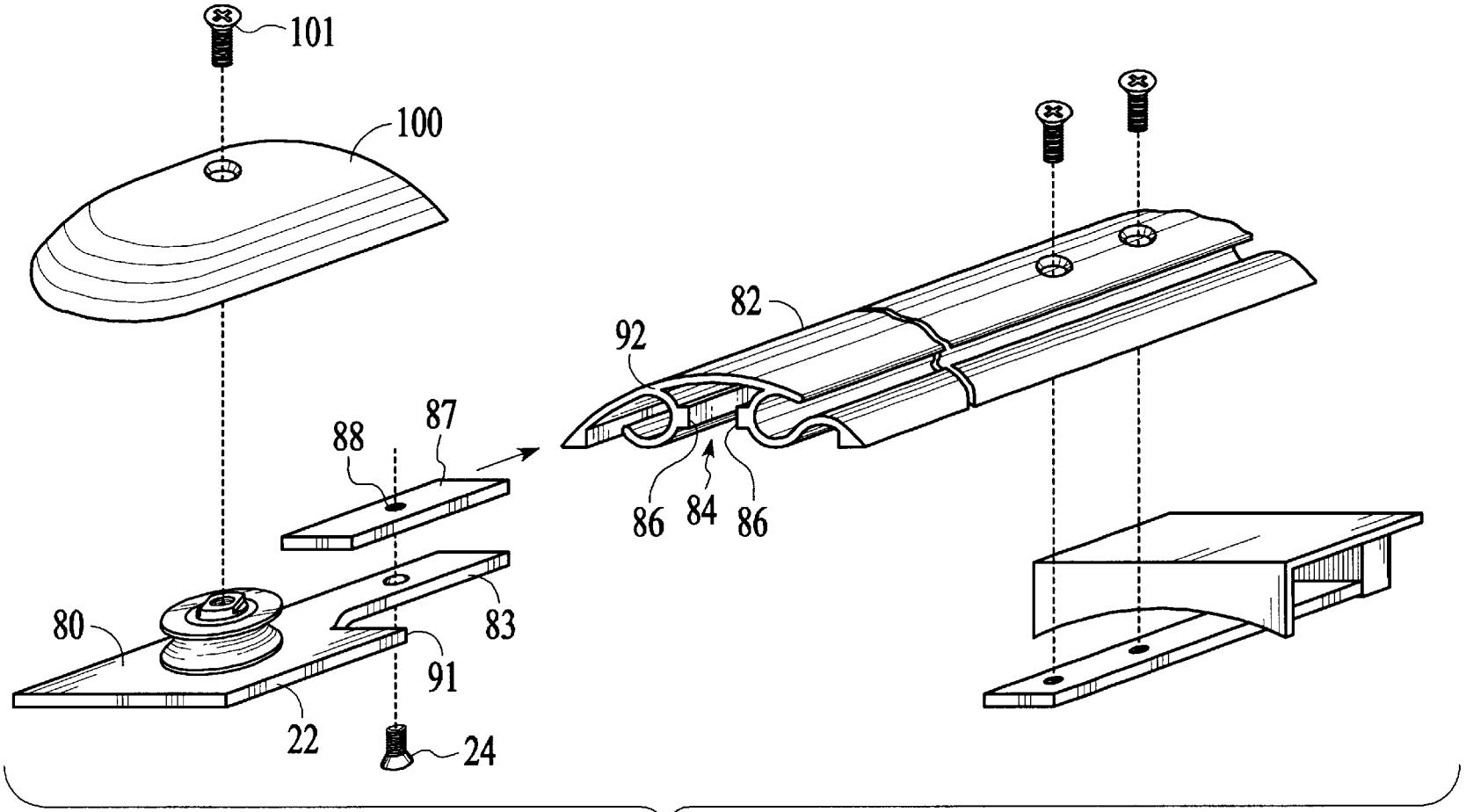

FIG. 10 is a perspective view of a disassembled top cover track system with a cover for and the novel radial pulley coupling plate assembly at one end of deck cover track and a mechanical slider stop at the other end of the track.

Figure 11:
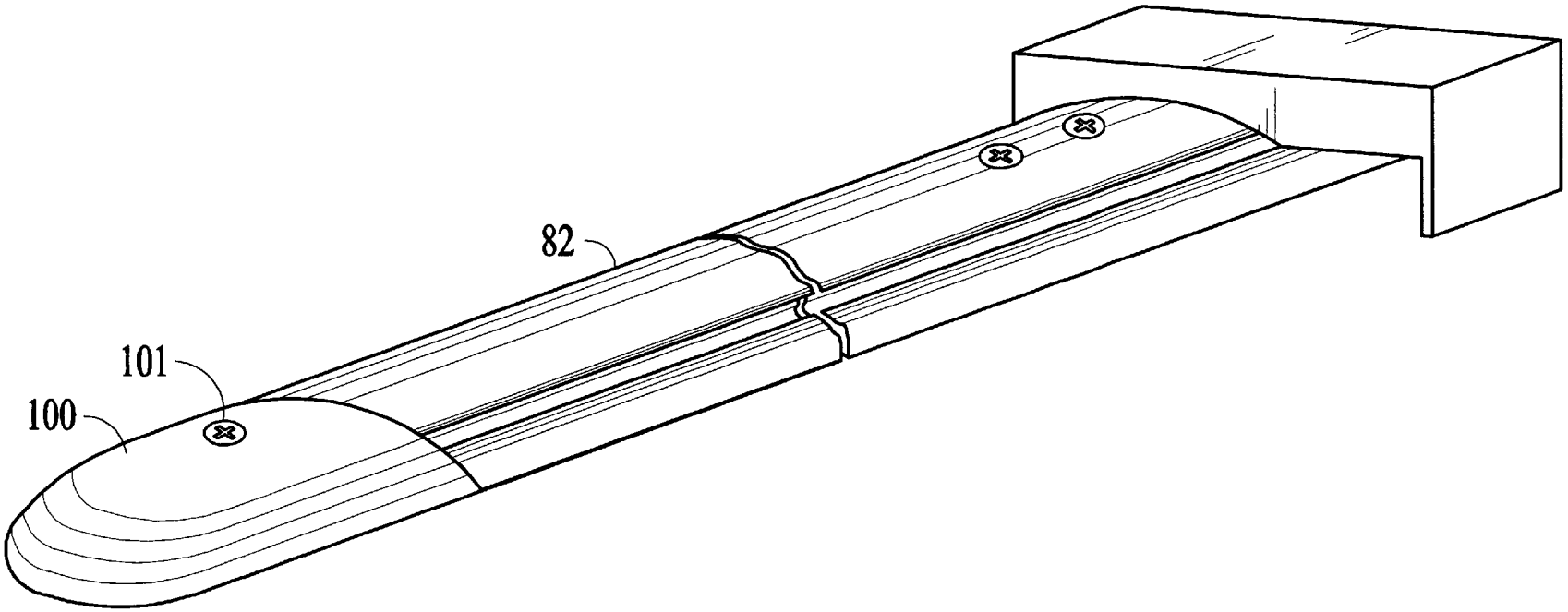
Figure 12:
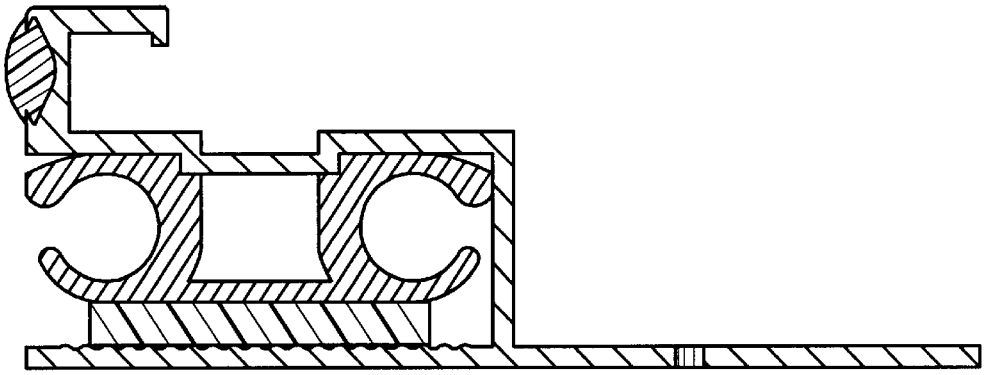

FIG. 11 is a perspective of the top cover track system shown in FIG. 12 assembled.

FIG. 12 is cross section elevation view of an extruded wall channel track for the invented track construct component system with an extruded element into which a light channeling plastic medium can be secured.

Figure 13:
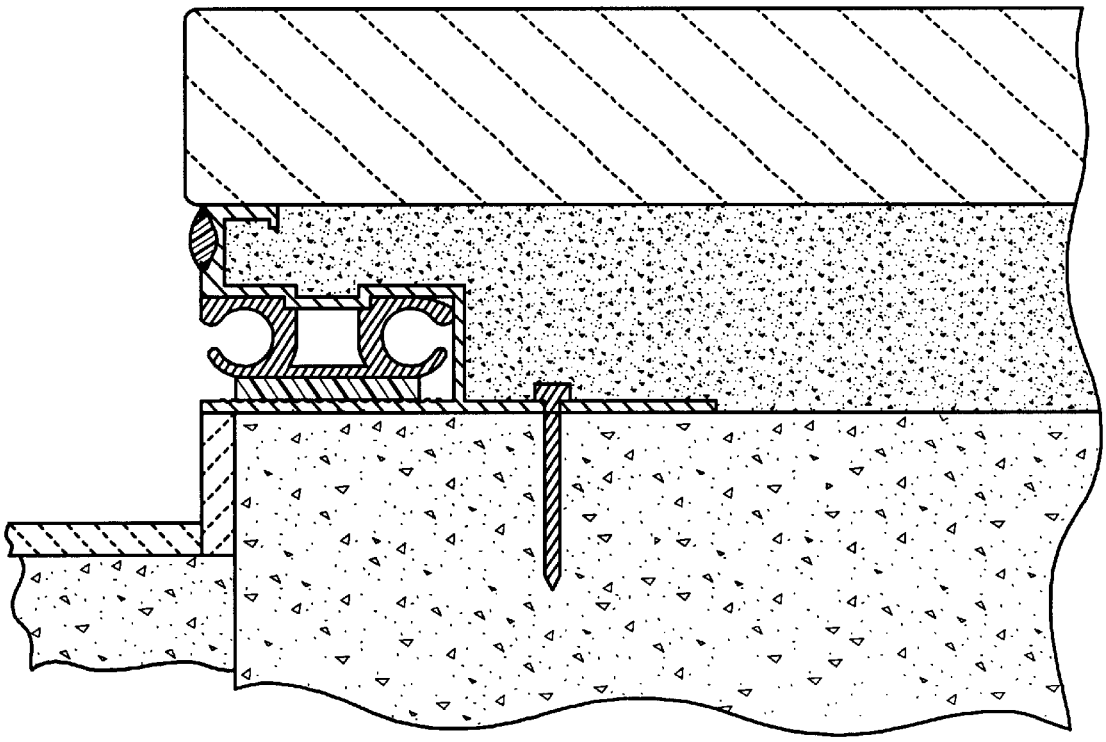

FIG. 13 is a cross section elevation views of the wall channel track shown in FIG. 12 incorporated into the side wall structure of the pool.

Figure 14:
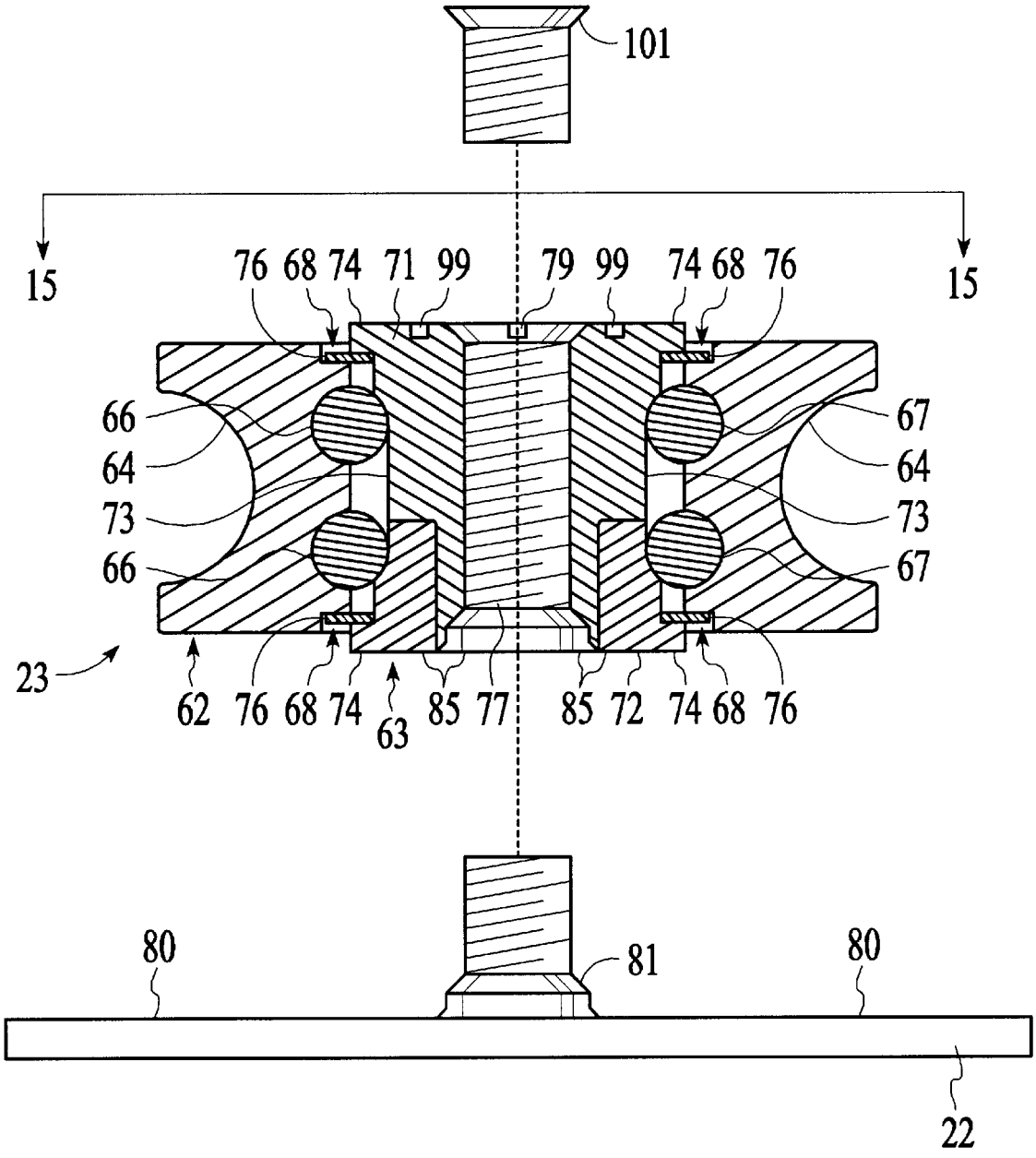

FIG. 14 is a cross section elevation view of the radial bearing end pulley assembly of the invented track construct component system showing details of the novel combination of a helically threaded annular inner bearing race screwing onto a complimentarily helically threaded post as a mechanism for fastening or securing radial bearing to the coupling plate, and providing a threaded recess for receiving an anchoring screw.

Figure 15:
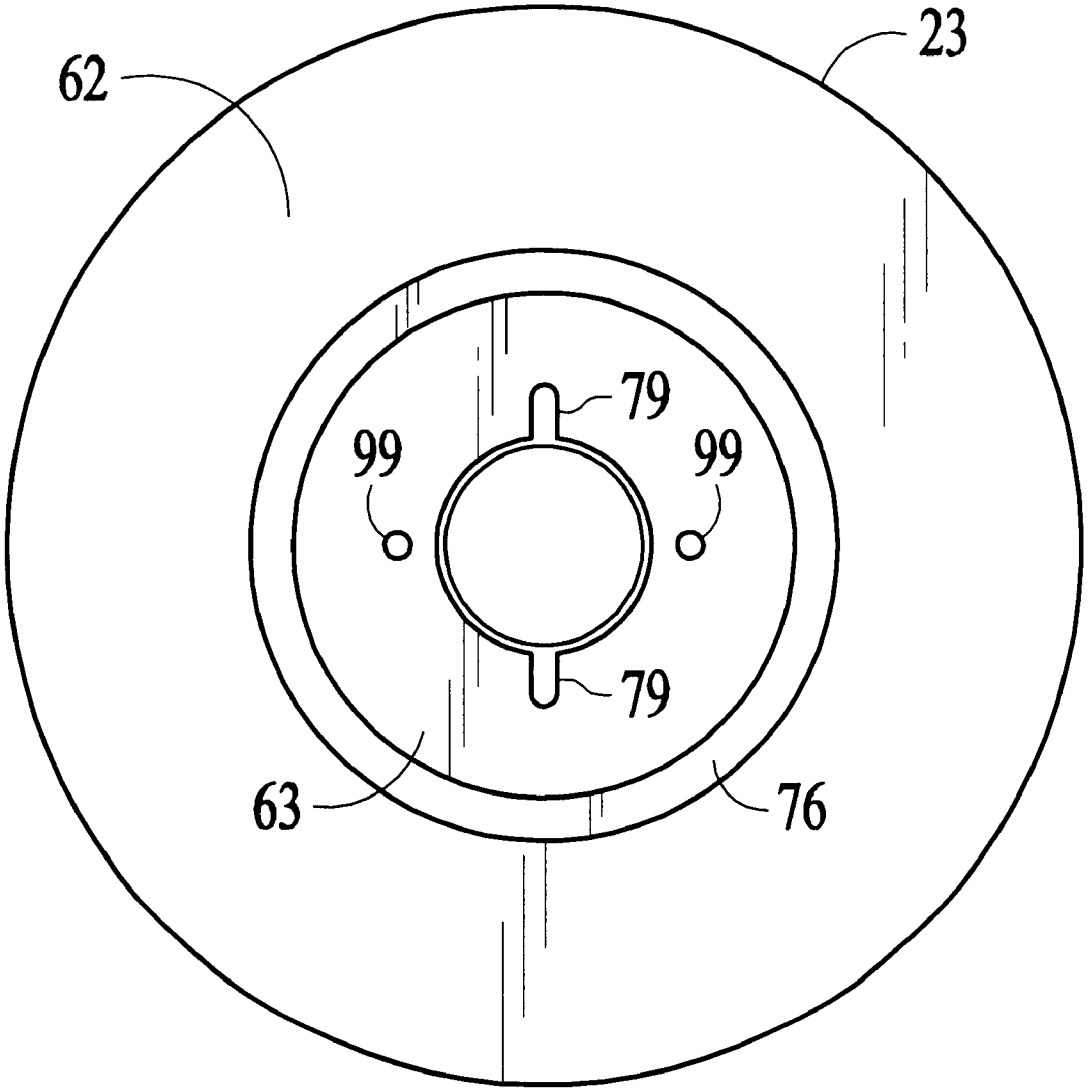

FIG. 15 is a top plan view of the radial end pulley assembly of the invented track construct component system viewed looking down from reference plane 15—15 of FIG. 14 showing a diametric slot and turning holes for mechanically rotating the inner bearing race for screwing onto a mounting post of a coupling plate.

DESCRIPTION OF PREFERRED AND EXEMPLARY EMBODIMENTS

FIGS. 1, 2, 3*a–d*, 4 and 6 show the relationship of the essential components of the invented track construct system. The extruded longitudinal cover track 11 has (i) a flat top face 12 with a longitudinal anchoring slot 13 and a planar base face 14; (ii) a longitudinal C-channel 16 with a slot opening 17 along one side edge 18 for capturing and holding a side edge of a pool cover and associated slider of a leading (front) edge structure (not shown); (iii) a longitudinal cable return channel 19 with a longitudinal slot opening 21 parallel C-channel 16 along the opposite side edge 20 for receiving and protecting cabling connecting between a slider, front cover comer and associated cable reels (not shown). A coupling plate 22 supporting a radial bearing end pulley 23 is conventionally fastened with tapered head screws 24 and nuts 25 at the distal end of the cover track 11 at the far pool end opposite the cover drum, cable reels and drive mechanisms.

An extruded wall channel structure 26 receives the cover track 11. The wall channel structure 26 is adapted for and incorporated into the side wall 27 (FIG. 6) of the pool 28 proximate the pool top 29 beneath a top deck/coping surface 30 that typically surrounds such pools. The extruded wall channel 26 structure has a top channel side wall 31 with a depending longitudinal land 32 extending toward an opposing flat, bottom channel side wall 33 and a back channel wall 37. The facing surface of the flat bottom channel side wall 33 is riffled with small longitudinal rills 35. The depending longitudinal land 32 is shaped to snuggly fit into the anchoring slot 13 in the top face 12 the cover track 11. A fastening apron 15 extends coplanar with the flat, bottom channel side wall 33 oppositely from the back channel wall 37. Holes 40 are drilled through the apron 15 for accommodating fastening nails screws or bolts 46 (FIG. 8*a*) which hold the wall channel structure 26 in place during and after construction of the pool wall 27.

A longitudinal spacer plate 34 is inserted between the flat, bottom channel side wall 33 of the wall channel structure 26 and the planar base face 14 of the cover track 11 for holding the cover track 11 within the wall channel 26 with the depending longitudinal land 32 mechanically fitting snuggly into the longitudinal anchoring slot 13 of the cover track 11. The longitudinal rills 35 on the facing surface of the flat, bottom channel side wall 33 functionally increase frictional engagement with the adjacent face of longitudinal spacer plate 34 while simultaneously minimizing adhesion between the abutting surfaces. The planar base face 14 of the cover track 11 may also have rills (not shown) to enhance frictional engagement with the opposite abutting face of the longitudinal spacer plate 34

FIGS. 7*a*, 7*b* and 7*c*, illustrate the procedure for insertion and removal of a cover track 11 into and out of a wall channel structure 26. FIG. 7*a* shows the cover track 11 mounted and secured within the wall channel structure 26 with the longitudinal spacer plate 34 in place. The longitudinal land 34 of the wall channel 26 is received within the anchor slot 13 of the cover track 11. To remove the cover track 11, the longitudinal space plate 34 is first slid sidewise out of the wall channel structure 26 (FIG. 7*b*) to allow the cover track 11 to drop down disengaging the longitudinal land 32 from the anchor slot 13 of the cover track. Once the longitudinal anchor slot 12 and longitudinal land 32 disengage, the cover track 11 is slid sideways out of the wall channel 26 (FIG. 7*c*).

To secure the cover track 11 within the wall channel structure 26, the procedure is reversed. The cover track 11 is slid sideways into the wall channel structure 26 and positioned such that its anchor slot 13 is aligned with the depending land 34 of the wall channel 26. Once the cover track 11 is properly located and aligned within the wall channel 26, the cover track 11 is lifted vertically within the channel inserting the depending longitudinal land 32 of wall channel structure 26 into the longitudinal anchor slot 13, until its top face 12 abuts against the top channel side wall 31 of the wall channel structure. The longitudinal spacer plate 34 is then slipped sidewise into a space between the planer base face 14 of the lifted cover track 11 and the 'rilled' surface 35 of the flat, bottom channel side wall 33 (FIG. 9*b*).

To facilitate placement of the cover track 11 in the wall channel 26, the skilled designer should dimension the wall channel 26 and cover track 11 such that back wall surface 37 of the wall channel structure 26 abuts against the return channel side edge 20 of the cover track for locating and aligning the land 32 and anchor slot 13 of the respective members. It should be noted that the respective flat top and base faces 12 & 14 of the cover track 11 curve inwardly at the side edges 18 & 20 toward each to define the respective C-channel and return channels slots 17 & 21 Accordingly, when the cover track 11 is pushed sideways against back wall surface 37 of the wall channel structure 26 there will be a longitudinal space for accommodating a small amount of debris captured between the sidewise sliding cover track 11 and the back channel wall surface 37 of the wall channel structure 26. However, the careful installer/repair person should always first clean obstructions and debris from the wall channel structure 26 before sliding in the cover track 11.

For reasons of manufacturing economy and simplifying use, conventionally, the C-channel 16 & slot 17 and return channel 19 & slot 21 of an extruded cover track 11 comprise mirror reflections of each other, i.e., typically cover tracks are symmetrical with respect to a longitudinal vertical plane bisecting the cover track 11 as illustrated in all the figures except FIG. 9. As the Applicant explains in U.S. Pat. Nos. 5,845,893 & 5,950,253, sometimes the advantages of a symmetrical configuration for an extruded cover track are outweighed by other mechanical factors, e.g., a need to accommodate sliders and/or to provide debris gutters. The skilled extrusion designer should appreciate that the return channel side edge 20 of the cover track 11 can be shaped of facilitate location and alignment of a cover track 11 within the wall channel 26. In fact, the side edge 20 of the cover track 11, the back side wall 37 of the wall channel 26, and the longitudinal land 32 depending from the upper side wall 31 of the wall channel structure 26 can each be shaped such that mechanically lifting the cover track 11 vertically within the wall channel structure 26, with its side edge 20 abutting against the back side wall 37 of the wall channel structure 26, mechanically positions and aligns the cover track 11 within the wall channel structure 26 for its anchor slot 13 to receive the longitudinal land 32 depending from the top channel side wall 31.

The process of inserting the longitudinal spacer plate 34 should be initiated at one end of the pool with the spacer plate being edged sidewise diagonally into the space between the lifted cover tack 11 and the flat, bottom side wall surface 33 in the manner illustrated in FIG. 9*b*. The careful installer/repairman might even use small spacer pieces for holding the cover track 11 in position within the wall channel structure 26 to ease the difficulty of the insertion.

The skilled designer/installer/repair person should also recognize that the longitudinal spacer plate 34 is quite critical to the workability of the invented track construct component system. In particular, the spacer plate 34 when inserted between the base face 14 of the cover track 11 and the rilled surface 35 of the flat, bottom channel side wall 33 of wall channel structure 26 maintains mechanical engagement of the longitudinal land 32 depending from the top side wall channel 31 in the cover track anchor slot 13. Accordingly, the spacer plate 34 should not vary significantly in thickness along its length. Materials selected for the longitudinal spacer plate 34 also should not swell or shrink appreciably over time in the expected water/chemical environment of the particular pool. Nor should the longitudinal spacer plates be composed of materials that chemically react with other elements in the pool environment including the other extruded components of the invented track construct component system. Longitudinal spacer plates 34 composed of polyvinyl chloride (PVC) with appropriate ultraviolet light opaquing additives are suitable for swimming pools environments.

Looking at FIG. 4, to facilitate of removal of a longitudinal spacer plate 34 from the space between the bottom planer base 14 of the cove track 11, the plate thickness (P) of the longitudinal spacer plate 34 may be chosen to be very slightly less than difference between the width (W) measured between the top and bottom channel side walls 31 and 33 of the wall channel structure 26 and the thickness (T) of the cover track 11, but significantly greater than the distance between the depending land and the, flat bottom channel side wall rilled surface 35. i.e.:

$$\{(W\text{-}T)\text{-}H\}<<P\leqq(W\text{-}T),$$

where H is the height of the land 34 depending from the surface of the top channel side wall 31 of the wall channel structure 26.

Thus, if depth (D) of the anchor slot 12 is slightly greater than the height (H) of the longitudinal land 32 depending from the top channel wall 31 of the wall channel 26, the space between the base 14 of the cover track 11 bottom channel side wall 33 can be increased slightly. This makes it possible to pry the longitudinal spacer plate 32 upward first, slightly, to break any adhesion of its bottom surface with the rilled surface 35 of the flat, bottom channel side wall 33. Once any adhesion is broken, the slight enlargement of the spacing enables the installer/repair person to easily work the longitudinal spacer plate 34 sidewise, diagonally out of the wall channel structure 26 preferable starting at an end of the particular spacer plate 34.

Ideally the longitudinal spacer plate 34 should extend the entire length of the cover track 11 within the wall channels 26. However, a plurality of spaced apart shorter lengths of longitudinal spacer plate 34 can be substituted for a single long length. Determining both the lengths and spacing between of such shorter spacer plates 34, consideration should be given to anticipated forces tending to disengage the anchor slot 12 of the cover track 11 from the depending land of the wall channel structure 26 and pulling the cover track 11 out of the wall channel structure 26. Such forces can arise from water/objects/people falling onto and being supported by the cover on the surface of the pool.

The skilled designer when considering the engagement of the anchor slot 14 of the cover track 11 and the longitudinal land 32 depending from the upper side wall 31 of the wall channel 26, should also pay attention to existence of torque moments arising from translation of components such as sliders within the C-channel 16 supporting leading edge structures spanning the pool. Such torque moments could tend to twist the track in a vertical plane. Accordingly, any designed yield in the vertical spacing of the secured cover track 11 within the wall channel structure 26, as discussed previously, should be determined with an objective to prevent the cover track from being deformed (bending) beyond its elastic limit. In other words, such designed for yield should not allow inelastic deformation of the cover track 11 due to expected ranges of operational forces that the invented track construct component system can be anticipated to experience during attempted extension and retraction of a pool cover in a failure (stuck) mode.

Looking again at FIGS. 7*a*, 7*b* & 7*c*, the far end wall of the pool opposite the cover drum cable reel and drive mechanisms (distal end wall) should also structurally incorporate an extruded wall channel structure 36 (typically having the same cross section configuration as side wall channel structure 26 as shown in phantom in FIGS. 7*a–c*) registering with the pool side wall channel structure 26 (FIG. 6). The coupling plate-radial bearing end pulley assembly 38 fastened at the distal end of the cover track 11 may extend from the side wall channel structure 26 (FIG. 5*a*) into the end wall channel structure 36 when mounted within a side wall channel structure 26. Alternatively, the side wall channel structure 26 can extend beyond the end of the coupling plate-radial bearing end pulley assembly 38 fastened at the distal end of the cover track 11 as shown in FIG. 5*b*. In the latter instance, the extruded end wall channel structure 36 would abut the opening 42 of the side wall channel structure 26. The depth of the extruded end wall channel structure 36 should be sufficient to allow the cover track 11 with the coupling plate-radial bearing end pulley assembly 38 fastened at its distal end to be first slid sidewise and then pivoted diagonally outward for removal from the side wall channel structure 26 after the longitudinal spacer plate 34.

Figure 3A:
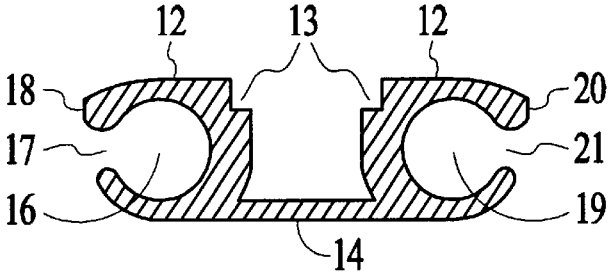
Figure 3B:
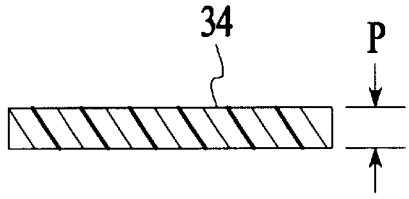
Figure 3C:
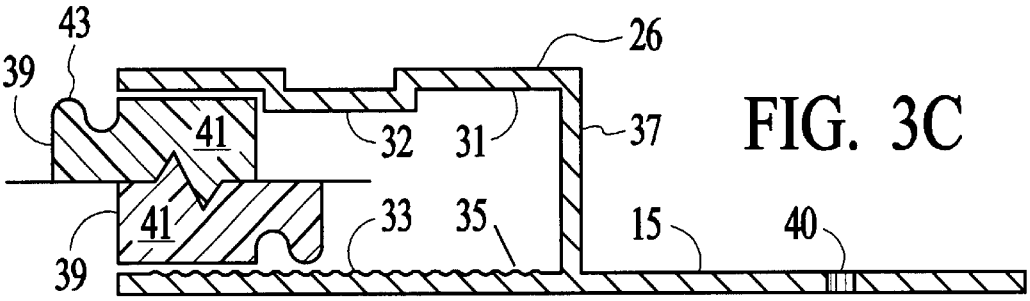
Figure 3D:
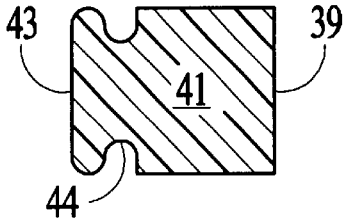

Looking at FIGS. 3*c* & 3*d*, longitudinal plastic rail plugs 39 conventionally inserted between the side walls 31 & 33 of a wall channel 26/36 during the construction phase of a pool to mitigate or prevent inadvertent structural deformation squeezing the channel side walls 31 & 33 together. Such rail plugs 39 typically include a hexahedral volume 41 with an integral head rail 43. Pry grooves 44 are typically molded/extruded at the juncture of the head rail 43 and hexahedral volume to facilitate removal of the rail plug from the opening 42 of the wall channel 26 36. The hexahedral volume 41 is dimensioned to compress slightly upon insertion into the opening 42 of the wall channel structure 36 The head rail 43 protrudes from the wall channel opening 42 and has a thickness dimension slightly less than that of the hexahedral volume 41, preferably just about equal to the spacing between the depending land 32 and the rilled surface 35 of the flat, bottom channel side wall 33. (See FIG. 6).

Post pool construction, instead of being discarded, such longitudinal plastic rail plugs 39, can be reversed and inserted into plugging the channel opening 42 of an end wall channel 36 (FIG. 5*c*) to prevent debris from floating or splashing into the end wall channel 36 and fouling the radial bearing end pulleys coupling plate assembly 38 carrying/returning cabling connecting between the sliders/front corners of the pool cover(not shown) and cable reels (not shown) of the cover drive mechanisms (not shown) extending and retracting the cover back and forth across a pool.

Turning now to FIGS. 8*a* & 8*b*, the extruded longitudinal wall channels structures 51 of the invented track construct component system for lined pool systems can be configured to adapt to an existing liner anchor channel structure 52 (FIG. 8*a*), or configured to include an integral liner anchor channel 53 for new pool construction (FIG. 8*b*).

In the adapted configuration (FIG. 8*a*) the adapting structure 54 integrally extruded with the wall channel structure 51 extends vertically (perpendicularly) downward from the horizontal bottom side wall 33 of the wall channel receiving a cover track (not shown) then horizontally (90°) backward in a series of stepped horizontal and vertical surfaces 56, 57, 58 & 59 The skilled extrusion designer should appreciated that the dimensions of the respective stepped horizontal and vertical surfaces 56–59 are determined by those of the existing liner anchor channel structure 52 over which it seats. For example: (i) stepped horizontal and vertical surfaces 56 are dimensioned to fit over the liner anchor channel of the liner anchor channel structure of the existing liner anchor channel structure 52; (ii) stepped horizontal and vertical surfaces 57 define a longitudinal support foot resting on the top of the anchor apron of the existing liner anchor channel structure 52; (iii) stepped horizontal and vertical surfaces 58 define a space for accommodate heads of fastener bolts anchoring the existing liner anchor channel structure 52 to the pool top 29; and (iv) horizontal surface 59 is the anchor apron for the extruded wall channel structure 51.

In the new construction adaptation (FIG. 8*b*), the liner anchor channel 53 and cover track wall channel 26 are extruded as a singe structure 51 with the liner anchor channel 53 vertically below the cover track wall channel 26 The liner anchor channel 53 includes a conventional small longitudinal upward projecting land 94 defining the bottom lip of the opening 93 into the channel. In like manner as illustrated in FIG. 6, the wall channel structure 51 shown in FIG. 8*b* can be incorporated into to form a part of the pool wall structure at the top of the pool 29 below a surrounding coping/deck surface 30.

The skilled extrusion designer should appreciate that while it is possible, it is not recommended to combine the mechanical features of a liner anchor channel and a cover track wall channel in a single channel rather than two channels as illustrated in FIG. 8*b*.—(This could be accomplished by providing a conventional upward projecting longitudinal land at the lip of the bottom channel side wall of the cover track wall channel, and letting the cover track and associated longitudinal spacer plate function as anchor railing to hold the liner cover edge within the channel.)—In particular, combining the liner anchor channel and cover track channel into a single channel would defeat the convenience of the invented system cover track, meaning that a single channel most likely, would make it necessary to drain the pool before extracting a cover track for a simple repair/replacement of, for example, an end pulley assembly. In addition, whether or not the pool is drained, a pool liner deformed by stress, stiffened by age, and embrittled by ultraviolet radiation and chemicals would greatly complicate both the extraction, reinsertion and anchoring of the cover track within the common channel. Finally, extraction, reinsertion and re-anchoring the cover track in such single wall channel would inevitably damage the integrity of the pool liner.

RADIAL BEARING END PULLEY AND COUPLING PLATE ASSEMBLY

Referring FIGS. 14 and 15, the invented radial bearing end pulley assembly 23 includes an outer annular race 62, and an inner annular race 63. The outer annular race 62 rotates relative to the inner race 63 and includes: (i) a concave, exterior, circumferential groove 64 designed for receiving, carrying and returning cabling common to swimming pool cover systems; (ii) at least one, preferably two, interior, concave circumferential ball bearing raceway grooves 66 for circumferentially aligning and holding a plurality of ball bearings 67; and (iii) annular end seal channels 68 cut radially into the interior wall of the race at each end of the annulus.

The inner annular race 63 is formed by a top annular member 71 pressure fitted into a bottom annular member 72 sandwiching and threading the outer annular bearing race 62. Together, the top and bottom annular members 71 & 72 provide conventional exterior, circumferential ball bearing rolling surfaces 73 terminating with radially projecting annular shoulder lands 74. Conventional Teflon® impregnated bearing debris seals 76 are captured and held between the inner race 63 and the outer annular race 62 within the annular end seal channels 68 by the projecting annular shoulder lands 7 of the inner annular race 63.

A helical thread 77 is cut into the interior cylindrical surface of the top annular member 71 and is sized to screw onto a post 81 welded to and integrally extending perpendicularly from a flat coupling plate 22. The post 81 has a complementary helical thread for screwing into the top annular member 71 of the inner annular bearing race 63 The flat coupling plate 22 preferably has a cheek area 80 surrounding the post 81 at least as large as the horizontal cross section area of the radial bearing end pulley assembly 23 carrying cabling in its concave, exterior, circumferential groove 64. Beyond the cheek surface, the coupling plate 22 is shaped and adapted for fastening at the ends of the various different types of cover track 11 (See FIGS. 2, 9, 10 & 11).

Figure 1:
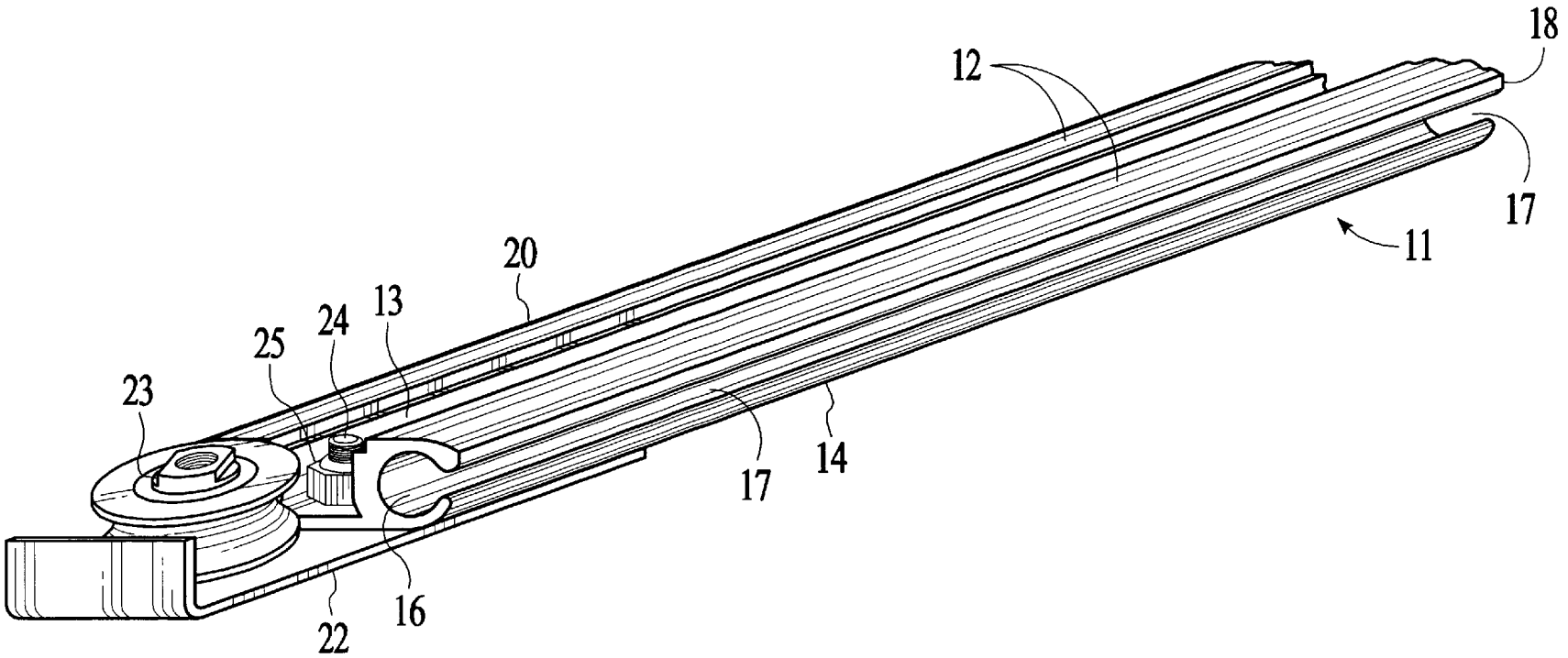
FIG. 1 is a perspective drawing of an extruded cover track with attached radial bearing end pulley assembly of the invented track construct component system.
Figure 2:
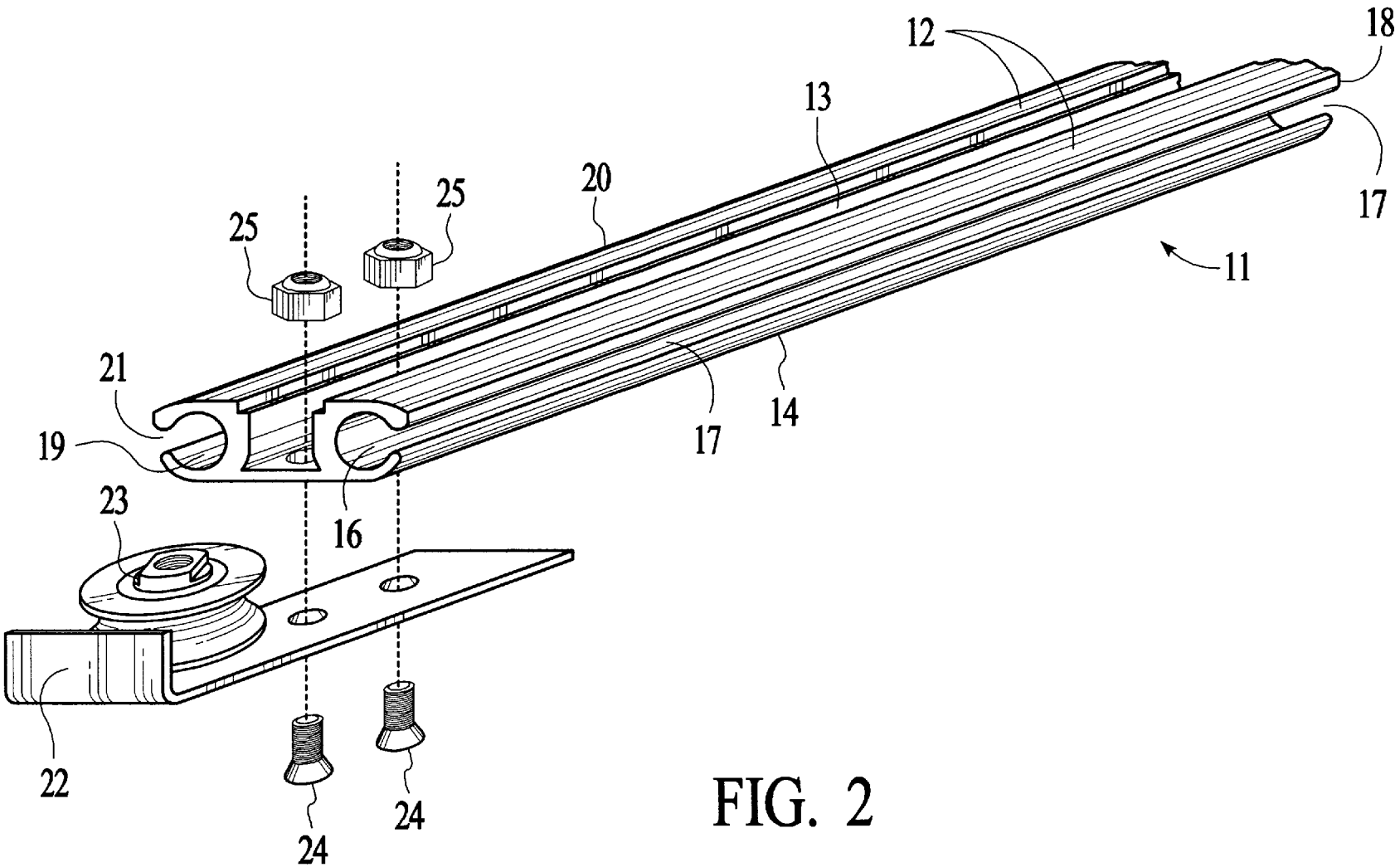
FIG. 2 is a perspective view illustrating how the radial end pulley assembly is secured at the end of the cover track of the invented track construct component system.

In particular, for the wall channel cover track 11 shown in FIG. 2, the coupling plate 22 is at most, as wide as the cover track 11 and has a thickness less than a longitudinal spacer plate 34. Accordingly, the coupling plate can be conventionally fastened to the planer base face 14 of the cover track 11 with tapered flat head screws 24 and nuts 25. Preferably, for wall channel and under-coping cover tracks of the configuration illustrated in FIGS. 1 & 2, the distal end beyond the cheek area 80 of the coupling plated 22 is bent upward to provide a protective vertical abutment protecting the radial bearing end pulley. (See also FIGS. 5*a*, 5*b*, & 7*a*–7*c*.)

For extruded deck cover track 82 shown in FIGS. 10 & 11, the coupling plate 22 includes a tang 83 extending from the cheek area sized to snuggly insert into a central space 84 defined between the exterior walls of the C-channel 16 and the return channel 19 of the deck cover track 82. As illustrated, the exterior walls of the C-channel 16 and return channel 19 of the deck cover track 82 each preferably include an integral longitudinal land 86 having rectangular cross section, projecting toward each other in a common plane. The tang 83 of the coupling plate is inserted below the projecting lands 86. A screw fastener plate 87 is sized to slip snugly into the space 84 between the exterior walls of the C-channel 16 and return channel 19 above the lands 86. The screw fastener plate 87 includes one or more threaded holes 88 for receiving a conventional tapered, flat head screw 24. Holes 89 are drilled through the cover plate tang 83 so that the screws 24 can be threaded into the threaded holes 88 of the screw fastener plate 87 and tightened onto the lands 86 for securing the coupling plate 22 at the end of the deck cover track 82.

The skilled installer/repair should appreciate that extending tang 83 of the coupling plate 22 is preferably not co-planer with coupling plate cheek area 80 which should bottom on the deck surface such that its proximate edges 91 abut against the end 92 of the deck cover track 82 for spacing the radial bearing pulley 23 away from such track end 92.

In the case of flush top cover track 96 of the type described by the Applicant in his U.S. Pat. Nos. 5,845,893 & 5,950,253 shown in , the tang 83 extending from the cheek area of the coupling plate 22 is size to snuggly insert into the central space 84 defined between the exterior walls of the C-channel 16 and return channel 19 close to the flush top 97 the track 96. In this case, holes 98 are drilled though the flush top 97 of the cover track 96. Corresponding tang holes are drilled and threaded to receive conventional tapered, flat head screws. In this case the screws are inserted through the flush top 97 of the cover track 96 thread into and are tightened to hold the extending tang 83 against the under surface of the flush top 97.

Looking now at FIGS. 14, 10 & 11, the top member 71 of the inner annular race 63 of the radial bearing end pulley assembly 23 screws onto the post 81 welded integrally extending perpendicularly from the flat coupling plate 22 and is tightened down with the end 85 of the bottom member 72 of the inner annular race 63 seating on the surface of the cheek 80 of the coupling plate 22. In the case of flush top cover track (FIG. 9) and top deck cover track (FIGS. 10 & 11), the height of the post 81 is selected to extend only part way through the threaded inner annular race 63 when fully tightened down on the threaded post 81. For example, the axial length L of the post 81 can be at least equal to half the axial length K of the inner annular race 63 which in turn is greater than the axial length J of the outer annular race 62, i.e., $K/2 \leqq L < J < K$. In this manner, a threaded receptacle proximate the end of such deck and flush top cover track is provided, ideally located for supporting and securing a pulley cap 100 covering and protecting the radial bearing pulley 23 and coupling plate 22 assembly by a complimentarily threaded flat or round head screw 101 that screws into the remaining threaded receptacle at the top of the threaded inner annular race 63.

A skilled installer/repair person should appreciate that the inner annular race 63 must be adapted to be mechanically rotated manually with a wrench or equivalent tool in order to tighten the radial bearing end pulley assembly 23 securely down on the threaded post 81. If vertical head space is minimal, a slot 79 can be cut diametrically across, or, alternatively turning holes 99 can drilled into the top face around the circumference of the top member 71 of the inner annular race 63 (See FIG. 15) to afford means for turning and tightening the radial bearing assembly down onto to the threaded post 81. Where there is sufficient vertical head space, diametrically opposing flats can be milled on the top projecting annular shoulder seal land 74 such that the top member 71 can be turned with a conventional wrench. (See FIGS. 1, 2 & *7a–7c*)

A skilled mechanical designer should appreciate that ball bearings 67 rolling within the annulus between outer and inner annular races 62 & 63 on the exterior bearing surfaces 73 of the inner annular race 63 end pulley assembly produce a torque tending to rotate the inner annular race 63 in the same direction as the rotating outer annular race 62. In circumstance where the rotation of the outer annular race 62 is in only one direction, the helical threads of the post 81 and interior surface of the inner annular bearing race 63 can be oriented such that such unidirectional torque tends to tighten the bearing down on the post 81.

However, in pool cover systems, the end pulleys carrying and turning the cabling rotate in both directions. In order to prevent, the invented radial bearing end pulley assembly screwed onto a helically threaded post from loosening it is sometimes necessary to peen (deform) the threads of the post 81 slightly to prevent such loosening rotation. In the case of top deck and flush top cover track systems the under surface of the pulley cap 100 abutting against the top end face of the top member 71 of the inner annular race 63 could be configured with a socket to receive and engage an eccentrically polygonal shaped projecting annular shoulder land 74 on the top end of the top member 71 of the inner annular race 63 to prevent such rotation. Other alternatives to peening and sockets could include a conventional locking washer compressed between the bottom end face of the bottom member 72 of the inner annular race 63 and the surface of the coupling plate 22.

Finally, the skilled designer should appreciate that the materials selected for the radial bearing an end pulley and coupling plate should be composed of steels and stainless steels that have high strength and low galvanic and chemical reactivity in the chemical environment of the particular pool.

The invented track construct component system with a threaded radial bearing end pulley has been described in context of both representative and preferred embodiments which have reference to automatic swimming pool cover systems invented and developed by the Applicant and others. It should be recognized that skilled engineers and designers can specify different cross section configurations for the extruded longitudinal components of the invented system which perform substantially the same function, in substantially the same way to achieve substantially the same result as those components described and specified above for the invented track construct component system. Similarly, the respective elements of the novel threaded radial bearing end pulley and coupling plate assembly may be configured differently, per constraints imposed by different mechanical systems, yet provide for threaded coupling of the inner race, or even the outer race, into a mechanical system which perform substantially the same function, in substantially the same way to achieve substantially the same result as those components described and specified by the Applicant above. Accordingly, while mechanical components suitable for incorporation into the invented track construct component system with a threaded radial bearing end pull are not exactly described herein, they will fall within the spirit and the scope of invention as described and set forth in the appended claims.

I claim:

1. A radial bearing-coupling plate assembly for a mechanical system comprising in combination, a) an outer annular bearing race having an exterior cylindrical surface adapted for engaging a movable element of the mechanical system and an interior cylindrical surface with at least one interior, concave circumferential ball bearing raceway groove for circumferentially aligning and holding a plurality of ball bearings, and b) an inner annular bearing race coaxially within the outer bearing race, having an exterior cylindrical surface providing at least one ball bearing rolling surface, and an inner cylindrical surface with a helical thread cut into it, and c) a cylindrical post integral with perpendicularly extending from a coupling plate, the post being sized and having helical thread cut into its exterior cylindrical surface for screwing into the inner annular bearing race to secure and position the inner and outer annular bearing races, and d) means for fastening the coupling plate in the mechanical system positioning the outer annular bearing race with its exterior engaging the movable element of the mechanical system.

2. The device of claim 1 wherein the exterior cylindrical surface of outer annular bearing race has a radius (r) and the coupling plate has a cheek surface radially surrounding the post of radius at least equal to the radius (r) of the exterior cylindrical surface of outer annular bearing race.

3. The device of claim 2 further including means for preventing rotation of the inner annular bearing race tending to screw the inner annular bearing race off of the post.

4. The device of claim 1 wherein the outer annular bearing race has an axial length (J), the inner annular bearing race has an axial length (K) and the post has an axial length (L) where:

$$K/2 \leq L < J < K,$$

for providing a fastening receptacle when the inner annular bearing race is screwed onto and tightened down on the post.

5. The device of claim 4 wherein the inner annular bearing race has a top end and a bottom end, the bottom end seating on the coupling plate, the top end having means for engaging a tool for rotating the inner annular bearing race facilitating screwing the inner annular bearing race onto and off of the post.

6. The device of claim 4 and further including, e) a cap element shaped for covering the assembly and abutting against a stationary element of the particular mechanical system having a hole drilled through it where the hole axially registers with the fastening receptacle with a helical thread, and f) a cylindrical fastener sized and having helical thread cut into its exterior cylindrical surface for screwing into the fastening receptacle of the inner annular bearing race to secure the cap element in the particular mechanical system covering the assembly.

7. The radial bearing-coupling plate assembly of claim 1 wherein the outer annular bearing race rotates in one direction and the helical threads cut into the interior cylindrical surface of the inner annular bearing race and into the exterior cylindrical surface of the post have a direction oriented such that rotation of the outer annular bearing race tends to screw the inner annular bearing race onto the post.

* * * * *